US010323346B2

(12) United States Patent
Lonati et al.

(10) Patent No.: US 10,323,346 B2
(45) Date of Patent: Jun. 18, 2019

(54) METHOD AND APPARATUS FOR ASSEMBLING A FABRIC STRIP TO A KNITTED ARTICLE

(71) Applicant: SANTONI S.P.A., Brescia (IT)

(72) Inventors: Ettore Lonati, Brescia (IT); Fausto Lonati, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 15/564,127

(22) PCT Filed: Mar. 25, 2016

(86) PCT No.: PCT/IB2016/051713
§ 371 (c)(1),
(2) Date: Oct. 3, 2017

(87) PCT Pub. No.: WO2016/157055
PCT Pub. Date: Oct. 6, 2016

(65) Prior Publication Data

US 2018/0080157 A1 Mar. 22, 2018

(30) Foreign Application Priority Data

Apr. 3, 2015 (IT) ..... BS2015A0055

(51) Int. Cl.
*D05B 35/06* (2006.01)
*D05B 23/00* (2006.01)
(Continued)

(52) U.S. Cl.
CPC ..... *D05B 35/06* (2013.01); *D04B 9/40* (2013.01); *D05B 23/007* (2013.01); *D05B 33/00* (2013.01)

(58) Field of Classification Search
CPC ..... D05B 33/00; D05B 23/007; D05B 35/06; D04B 49/40
See application file for complete search history.

(56) References Cited

U.S. PATENT DOCUMENTS 5,437,238 A * 8/1995 Price ..... D05B 33/00 112/153
5,522,332 A * 6/1996 Price ..... D05B 33/00 112/306

(Continued)

FOREIGN PATENT DOCUMENTS

WO 96/10344 A2 4/1996

OTHER PUBLICATIONS

Jun. 20, 2016 International Search Report issued in International Patent Application No. PCT/IB2016/051713.

(Continued)

*Primary Examiner* — Danny Worrell
(74) *Attorney, Agent, or Firm* — Oliff PLC

(57) ABSTRACT

A method and related apparatus for assembling a fabric strip to a knitted article. The method includes the steps of loading a knitted article onto a loading form, wrapping at least an end portion of the knitted article so that an open end thereof is accessible, loading a fabric strip onto loading members, and wrapping it thereon so that a first welt is accessible. Additionally, the method includes mutually positioning the loading form and the loading members by aligning the loading form with respect to the loading members, introducing the loading form into an inner space of the loading members so that the fabric strip surrounds outside the end portion of the knitted article, and letting the first welt overlap and match the open border.

20 Claims, 9 Drawing Sheets

(51) Int. Cl.
*D05B 33/00* (2006.01)
*D04B 9/40* (2006.01)

(56) References Cited

U.S. PATENT DOCUMENTS 5,562,060 A * 10/1996 Price ..... D05B 33/00
112/272
5,570,647 A * 11/1996 Adamski, Jr. ..... D05B 33/00
112/153
5,709,162 A 1/1998 Pagett et al.
5,743,202 A 4/1998 Price et al.

OTHER PUBLICATIONS

Jun. 20, 2016 Written Opinion issued in International Patent Application No. PCT/IB2016/051713.

* cited by examiner

METHOD AND APPARATUS FOR ASSEMBLING A FABRIC STRIP TO A KNITTED ARTICLE

The present invention relates to a method and an apparatus for assembling a fabric strip to a knitted article. The invention falls into the technical field of machines and equipment for producing tights and other hosiery or knitwear items, starting from tubular textile articles, and relates in particular to the loading and joining operations performed on knitted articles in order to make, in particular make up and finish, a knitted item.

As is known, tights are made starting from two tubular knitted articles, identical to one another and representing each a leg of the tights, and typically involve a "toe sewing machine" or "toe closer" and also another machine known as "line closer", for joining the two legs in order to create the tights. The toe closer is designed to close the toe of each one of the aforesaid tubular knitted articles, i.e. the toe of each leg of the stocking, whereas the line closer subjects the opposite leg end to a longitudinal cut on a portion which, in the end product, represents the body, and then to a seaming operation on the edges previously cut.

Conversely, in another type of tights the body is made directly by means of a knitting machine as one piece already including both legs, the body and the upper portion designed to wrap the user's body on the abdomen and bottom.

In general, some tights also feature another portion made up of a circular band sewn on the upper end of the tights and designed to wrap the user's waist; this band basically represents an upper border of the tights. The circular band is typically elastic, i.e. more elastic than the body of the tights, and can support the tights once worn or improve the comfort thereof.

When manufacturing tights with an upper border, typically the body is made (comprising the two legs joined to one another or made as one piece) and then a circular fabric strip is prepared; then the strip is joined—usually by seaming—to the body of the tights, so that both parts are made integral to one another and a pair of tights with a border is obtained. The manufacturing process is typically performed manually by an operator who prepares the body of the tights, joins the fabric strip and seams it. It is known about the use of fixed forms on which the body of the tights can be placed and stretched so as to make it easier to seam the fabric strip onto the waist.

It is further known about other textile items comprising fabric strips or bands sewn to the body of the textile item. To be mentioned are for instance elastic bands for underwear (underpants, pants, etc.) or cuffs and collars for knitted items.

Here again, as is known, the fabric strips or bands are manually sewn to the corresponding destination edges. The Applicant has found that known methods for assembling fabric strips to knitted articles are not without drawbacks and can be improved under various aspects. In particular, known methods are characterized by complex operations and working cycles, which typically require a large use of manpower. Moreover, the productivity of these methods is necessarily low, since manual operations require long times. Furthermore, the assembling operations of fabric strips designed to be borders, cuffs, collars, etc. represent a bottleneck in the manufacturing processes of a textile item: as a matter of fact, the operator must manually load a knitted items onto a dedicated form and then sew the fabric strips one by one.

Basically, the Applicant has found that known methods are characterized by low productivity and/or by high manufacturing costs for a single textile item (in particular a pair of tights) and/or by highly complex manufacturing cycles. Moreover, known methods require a large use of manpower, which results in an increase of manufacturing times and costs. More to the point, the Applicant has found that known methods can lead to errors when manufacturing the textile item, in particular when sewing a fabric strip, such as a border, an elastic band, a cuff, to a knitted article. This can result in a low quality or defective textile item.

Moreover, a drawback of known methods is related to the difficulty in obtaining textile items, such as tights, having uniform aesthetic and functional characteristics, i.e. the difficulty in ensuring a high repeatability in the manufacturing process.

The aim of the present invention is to obviate one or more of the drawbacks mentioned above. A further aim of the invention is to provide a method and an apparatus for assembling a fabric strip to a knitted article, which enable to make high quality textile items basically without imperfections. Another aim of the invention is to provide a method and an apparatus for assembling a fabric strip to a knitted article, which enable to reduce manufacturing waste. Another aim of the invention is to provide a method and an apparatus for assembling a fabric strip to a knitted article, which enable to assemble a fabric strip to a knitted article in a simple, fast and repeatable manner.

Another aim of the invention is to provide a method and an apparatus for assembling a fabric strip to a knitted article, which enable to reduce manpower used for tights manufacturing.

A further aim of the invention is to provide a method and an apparatus for assembling a fabric strip to a knitted article, which enable to increase productivity and/or reduce the time required for manufacturing textile items, in particular tights. Another aim of the invention is to provide a method and an apparatus for assembling a fabric strip to a knitted article, which enable to obtain a high uniformity across the various items produced. Another aim of the invention is to provide a method and an apparatus for assembling a fabric strip to a knitted article, which enable to make textile items, in particular tights, in a simple, fast and/or automatic manner. Another aim of the invention is to provide an apparatus for assembling a fabric strip to a knitted article, which is simple and/or robust and/or cheap to make. Another aim of the invention is to provide an apparatus for assembling a fabric strip to a knitted article, which can be integrated into already existing plants for manufacturing textile items.

These and other aims, which shall appear better from the following description, are basically achieved by a method and an an apparatus for assembling a fabric strip to a knitted articles according to the appended claims, in any combination with one another and/or with one or more of the aspects referred to below.

In a first aspect, the invention relates to a method for assembling a fabric strip to a knitted article, wherein said knitted article exhibits an end portion ending with a basically circular open border designed to be joined to said fabric strip, and wherein said fabric strip has a basically ring-like shape and has a first welt designed to be joined to said open border of the end portion of the knitted article.

In one aspect, the method comprises the following steps:

arranging a device for preparing a knitted article, comprising at least a loading form provided with at least an outer loading surface developing around a first central axis and ending with a basically circular first edge;

at least partially loading a knitted article onto said at least one loading form, wrapping at least an end portion of the knitted article outside the loading form so that the end portion adheres to said outer surface and at a certain distance from the first central axis, and so that the open border lies beyond the first edge and protrudes inwardly from the first edge towards said first central axis;

arranging a device for preparing a fabric strip, comprising at least loading members configured for receiving outside a fabric strip destined to be assembled to the knitted article and for placing the fabric strip around a second central axis;

at least partially loading a fabric strip onto said loading members, wrapping the fabric strip outside the loading members so that the fabric strip adheres to the loading members at a greater distance from said second central axis than the respective distance of the end portion of the knitted article from the first central axis, and so that the first welt protrudes inwardly from the loading members towards said second central axis.

In one aspect, the method comprises the step of mutually positioning said loading form and said loading members, wherein said step of mutually positioning comprises the following steps:

aligning said loading form with respect to said loading members, so that said first central axis is basically coincident with said second central axis;

introducing the loading form into an inner space of the loading members, letting the portion of knitted article wrapped outside the loading form faced to the fabric strip wrapped around the loading members, so that the fabric strip surrounds outside the end portion of the knitted article and lies concentrically with respect to the latter;

letting the first welt of the fabric strip overlap and match the open border of the knitted article and basically in contact with it.

In one aspect, the method comprises the step of taking the fabric strip out of the loading members so as to move it onto the loading form, keeping the mutual position taken by the first welt of the fabric strip and by the open border of the knitted article, the fabric strip being placed on the loading form outside the end portion of the knitted article.

In one aspect, the method comprises the step of joining the first welt of the fabric strip to the open border of the knitted article, so as to obtain an assembled knitted article.

In one aspect, said joining step comprises a step of sewing together, or heat-sealing or gluing or resin-coating or taping, the first welt of the fabric strip and the open border of the knitted article.

In one aspect, the loading members define a wrapping surface on which the fabric strip is placed, said wrapping surface having a smaller axial size than said height of the fabric strip.

In one aspect, the step of loading the fabric strip comprises the following steps:

positioning the fabric strip around the loading members so that the first welt protrudes above from the loading members for a length corresponding to the difference between said axial size of the loading members and said height of the fabric strip, wherein in said positioning step the fabric strip is slack;

expanding (circumferentially placing at a mutual distance) the loading members as far as said greater distance from said second central axis than the distance of the end portion of the knitted article from the first central axis, and stretching the fabric strip so that it adheres to the loading members for a portion corresponding to the axial size of the loading members, and so that said length of fabric strip protruding above from the loading members gets back to said second central axis and is stretched as far as the first welt.

In one aspect, in the step of loading the fabric strip, after said step of expanding the loading members, the first welt protrudes inwardly from the loading members towards said second central axis, in a direction basically perpendicular to said wrapping surface of the loading members.

In one aspect, after said step of introducing the loading form into an inner space of the loading members, the step of letting the first welt of the fabric strip match the open border of the knitted article comprises a step of narrowing (concentrically approaching) the loading members towards the second axis, so as to approach the fabric strip and bring it basically into contact with the end portion of the knitted article, and so that said length of fabric strip getting back from the loading members towards the second central axis lies over the portion of knitted article protruding inwardly from the first edge of the loading form and ending with said open border.

In one aspect, the step of taking the fabric strip out of the loading members so as to move it onto the loading form comprises a step of moving the loading members away from the loading form, so that the loading members are taken out of the fabric strip letting the latter adhering outside the end portion of the knitted article.

In one aspect, the knitted article is a tubular knitted article. In one aspect, the knitted item is a pair of tights or a knitted item or a piece of underwear.

In one aspect, the loading disc extends axially from the first edge to a second edge, from which the knitted article freely hangs on said loading form or gets (preferably is sucked) into the inner hollow of the loading form (preferably into the opening of the lower end of the sucking tube). In one aspect, after said step of joining the first welt of the fabric strip to the open border of the knitted article, the knitted article thus obtained is made as one piece.

In one independent aspect thereof, the present invention relates to a method for assembling a fabric strip to a knitted article, comprising the following steps:

loading a knitted article onto a loading form, wrapping outside the loading form at least an end portion of the knitted article, so that an open end of the knitted article is accessible;

loading a fabric strip onto loading members, wrapping the fabric strip onto the loading members so that a first welt of the fabric strip is accessible;

mutually positioning the loading form and the loading members, by means of the following step:

aligning the loading form with respect to the loading members;

introducing the loading form into an inner space of the loading members, so that the fabric strip surrounds outside the end portion of the knitted article;

letting the first welt overlap and match the open border;

taking the fabric strip out of the loading members so as to move it onto the loading form, keeping the mutual position taken by the first welt and by the open border.

In one aspect, the method comprises the step of joining the first welt to the open border so as to obtain an assembled, one-piece knitted article.

In an independent aspect thereof, the invention relates to an apparatus for assembling a fabric strip to a knitted article, wherein said knitted article exhibits an end portion ending with a basically circular open border destined to be joined to said fabric strip, and wherein said fabric strip has a basically ring-like shape and has a first welt destined to be joined to said open border of the end portion of the knitted article.

In one aspect, the apparatus comprises at least:

a device for preparing a knitted article, comprising at least a loading form provided with at least an outer loading surface developing around a first central axis and ending with a basically circular first edge, wherein said loading form is configured for being wrapped outside at least by an end portion of the knitted article, so that the end portion adheres to said outer surface and at a given distance from the first central axis, and so that the open border lies beyond the first edge and protrudes inwardly from the first edge towards said first central axis;

a device for preparing a fabric strip, comprising at least loading members configured for receiving outside a fabric strip destined to be assembled to the knitted article and for placing the fabric strip around a second central axis, wherein said loading members are configured for being wrapped outside by at least a portion of a fabric strip, so that the fabric strip adheres to the loading members at a greater distance from said second central axis than the respective distance of the end portion of the knitted article from the first central axis, and so that the first welt protrudes inwardly from the loading members towards said second central axis.

In one aspect, the apparatus further comprises moving mechanisms configured and arranged for mutually positioning in an automatic manner said loading form and said loading members, so as to:

align said loading form with respect to said loading members, with said first central axis basically coincident with said second central axis;

introduce the loading form into an inner space of the loading members, placing the portion of knitted article wrapped outside the loading form in front of the fabric strip wrapped around the loading members, so that the fabric strip surrounds outside the end portion of the knitted article and lies concentrically with respect to the latter;

let the first welt of the fabric strip overlap and match the open border of the knitted article and basically in contact with it.

In one aspect, the moving mechanisms comprise positioning means for the loading form, configured for aligning the loading form with respect to the loading members, for introducing the loading form into an inner space of the loading members, and for letting the first welt overlap and match the open border of the knitted article. In one aspect, the apparatus can comprise two or three or four or more than four of said loading forms, cyclically moved so as to parallelize the operations for assembling fabric strips to respective knitted articles.

In a further independent aspect thereof, the present invention relates to a machine for manufacturing tights comprising an apparatus for assembling a fabric strip to a knitted article according to any one of the claims and/or of the aspects and/or configured and arranged for implementing the method according to any one of the claims and/or of the aspects, and further comprising a sewing machine of the "overlook" "cut-and-sew" type and/or a toe sewer and/or a line closer.

Each one of the aforesaid aspects of the invention can be considered alone or in combination with any one of the claims or of the other aspects as described.

Further characteristics and advantages shall be more evident from the detailed description of a preferred, though not exclusive embodiment, according to the accompanying figures, in which:

FIG. 1 shows a perspective front view of a possible embodiment of an apparatus for assembling a fabric strip to a knitted article according to the present invention, in a first operating condition;

FIG. 1A schematically shows a knitted article and a fabric strip destined to be assembled by means of a method and/or an apparatus according to the present invention;

With reference to the figures mentioned above, the numeral 1 globally designates an apparatus for assembling a fabric strip to a knitted article according to the present invention.

The apparatus of the present invention is configured for working on knitted articles, in particular on tubular knitted articles for producing tights, and on fabric strips designed to represent welts, bands, elastics or in general end portions of the knitted article manufactured starting from the knitted article.

Figure 1A:
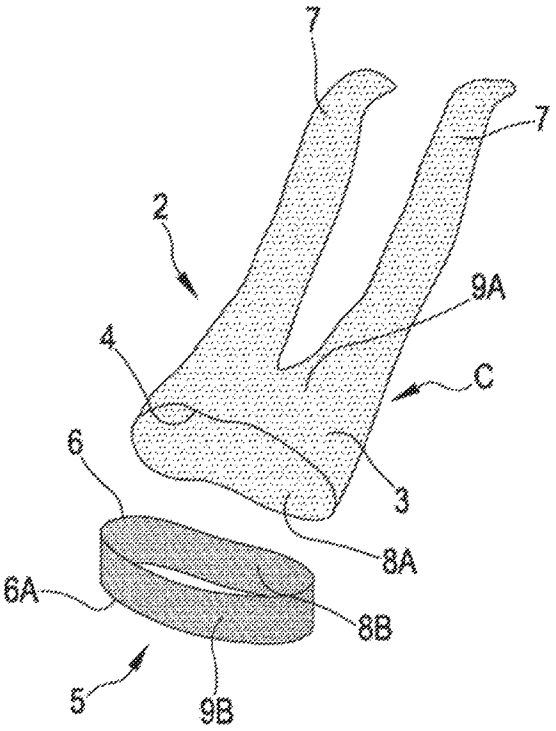

By way of example, as schematically shown in FIG. 1A, the knitted article 2, in this case a pair of tights C, exhibits an end portion 3 ending with a basically circular open border 4 destined to be joined to the fabric strip 5. The fabric strip 5 has a basically ring-like shape and exhibits a first welt 6 destined to be joined to the open border 4 of the end portion 3 of the knitted article.

In FIG. 1A, the knitted article is a pair of tights C, however the method and apparatus of the present invention are configured for working with any knitted article to which a fabric strip has to be assembled. To be mentioned are for instance cuffs or collars to be applied to knitted items, the edge of a pair of trousers or the elastic band to be applied to the waist of underwear items, e.g. underpants or the like. In general, the knitted article 2 has an open border 4 to which a welt 6 of the fabric strip 5 is assembled.

In the framework of the present invention, the term "knitted" or "fabric" means that the article and/or the strip are made of a textile material produced by a knitting machine. As an alternative, the present invention also applies to articles and/or strips made of other materials, e.g. synthetic sheets, films, membranes and the like. In the framework of the present description and claims, the term "assembling" means attaching or joining the fabric strip 5 to the knitted article 2, so as to obtain a knitted article made as one piece.

The term "strip" of fabric indicates a knitted article shaped as a ring-like ribbon or band, destined to match the open border of the knitted article and represent, once joined thereto, an edge of the knitted article.

The words "border" or "welt" generally means an open edge, end or profile of the knitted article or of the fabric strip.

Figure 1:
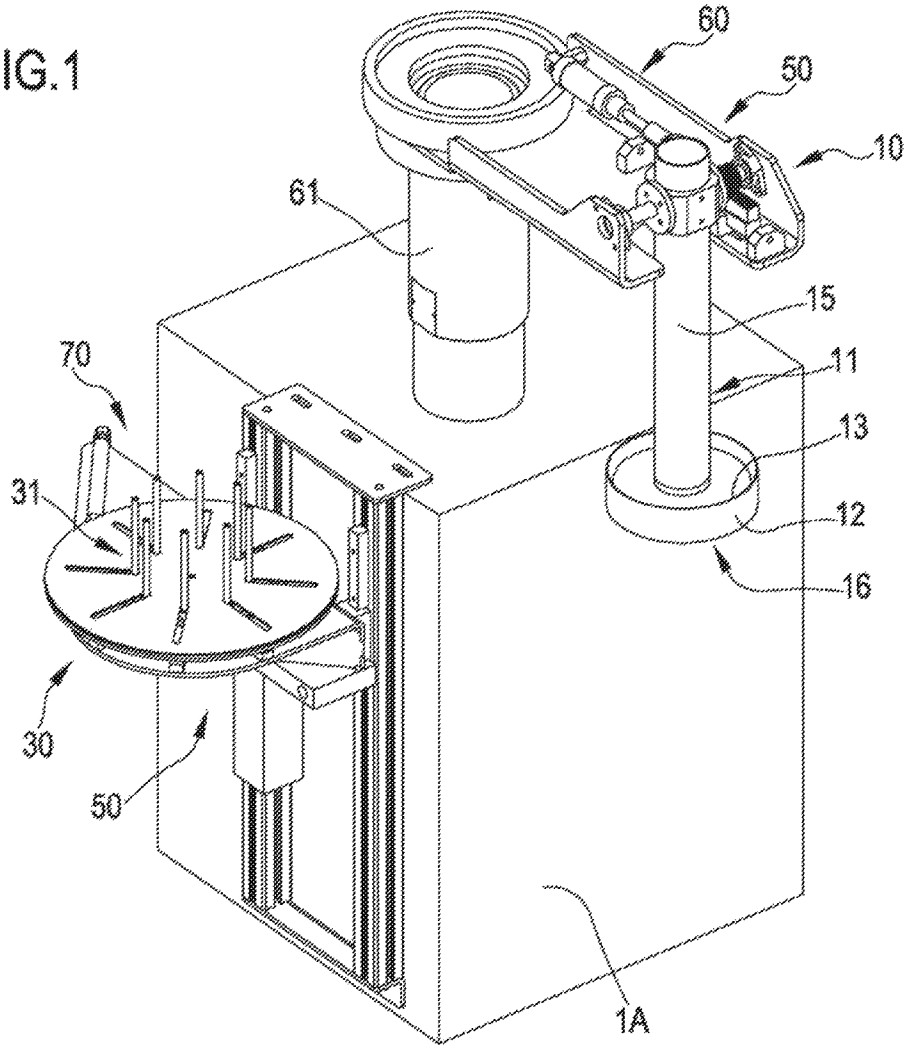

As shown by way of example in FIG. 1, the assembling apparatus 1 comprises first of all a device 10 for preparing a knitted article, comprising at least a loading form 11 provided with at least an outer loading surface 12 developing around a first central axis A1 and ending with a basically circular first edge 13. The loading form 11 is configured for being wrapped outside at least by the an end portion 3 of the knitted article 2, so that the end portion adheres to the outer surface 12 and is placed at a certain distance from the first central axis A1, and so that the open border 4 lies beyond the first edge 13 and protrudes inwardly from the first edge 13 towards the first central axis A1. The positioning of the end portion 3 and of the open border 4 of the knitted article, once loaded onto the loading form 11, is shown by way of example in FIGS. 2, 3 and 5A.

In practice, the end portion of the knitted article is loaded onto the outer surface 12 of the loading form so that the open border 4 lies beyond the first edge 13; since the end portion is stretched on the outer surface 12, the open border 4—as a result of the elasticity characterizing the knitted article—gets back from the first edge 13 into the loading form. The portion of the knitted article getting back from the first edge 13 is free and accessible for subsequent joining operations (preferably by sewing) to the fabric strip, as will be explained in detail below.

The apparatus 1 further comprises a device 30 for preparing a fabric strip, comprising loading members 31 configured for receiving outside a fabric strip 5 destined to be assembled to the knitted article 2 and for placing the fabric strip around a second central axis A2. The loading members 31 are configured for being wrapped outside by at least a portion of the fabric strip, so that the fabric strip adheres to the loading members themselves at a greater distance from the second central axis A2 than the respective distance of the end portion of the knitted article from the first central axis A1. The loading members are configured so that the first welt 6 of the fabric strip 5 wrapped thereon protrudes inwardly from the loading members 31 towards the second central axis A2. The positioning of the fabric strip, in particular of the first welt 6, once loaded onto the loading members 31, is shown by way of example in FIGS. 5A and 6.

In practice, the fabric strip 5 is loaded outside the loading members 31 so that the first welt lies above beyond the loading members themselves; since the fabric strip 5 is stretches outside the loading members, the first welt 6—as a result of the elasticity characterizing the fabric strip—gets back from an upper end of the loading members into the members themselves. The portion of the fabric strip getting back from the loading members is free and accessible for subsequent joining operations (preferably by sewing) to the knitted article, as will be explained in detail below.

The apparatus 1 further comprises moving mechanisms 50 configured and arranged for mutually positioning in an automatic manner the loading form 11 and the loading members 31, so as to:

- align the loading form 11 with respect to the loading members 31, with the first central axis A1 basically coincident with the second central axis A2;
- introduce the loading form 11 into an inner space 32 of the loading members 31, placing the portion of knitted article 2 wrapped outside the loading form 11 in front of the fabric strip 5 wrapped around the loading members 31, so that the fabric strip 5 surrounds outside the end portion of the knitted article and lies concentrically with respect to the latter;
- let the first welt 6 of the fabric strip 5 overlap and match the open border 4 of the knitted article 2 and basically in contact with it.

The mutual positioning in an automatic manner of the loading form 11 and of the loading members 31 will be explained in further detail below, referring in particular to the method according to the present invention.

Preferably, the moving mechanisms 50 comprise positioning means 60 for the loading form 11, configured for aligning the loading form with respect to the loading members, for introducing the loading form into the inner space 32 of the loading members, and for letting the first welt 6 overlap and match the open border 4 of the knitted article. Preferably, the moving mechanisms 50 comprise actuating means 70 for the loading members 31 configured for taking the fabric strip 5 out of the loading members so as to move it onto the loading form 11, keeping the mutual position taken by the first welt 6 of the fabric strip and by the open border 4 of the knitted article.

Preferably, the apparatus comprises a joining device configured and arranged for joining the first welt of the fabric strip to the open border of the knitted article, so as to obtain one assembled knitted article (made as one piece). The joining device is not shown in the figures, since it can be of known type. By way of example, the joining device is a sewing machine or a heat-sealing machine or a gluing machine. More preferably, the sewing machine can be an "overlook" "cut-and-sew" machine, e.g. a machine as those produced by UNION SPECIAL® in one of the models of series 9M or the like. The seam made between the first welt 6 of the fabric strip and the open border 4 of the knitted article is preferably of the "4-needle" type.

Preferably, the positioning means 60 are configured for moving the loading form 11 carrying the knitted article and the fabric strip, and for subjecting it to the joining device. In an embodiment not shown, the apparatus can comprise members for automatically unloading the assembled knitted article from the loading form.

Preferably, as shown in the exemplary embodiment of the figures, the loading form 11 comprises a supporting tube 15 supporting a loading disc 16. The loading disc 16 exhibits the aforesaid outer loading surface 12 and the aforesaid first edge 13.

Preferably, the loading disc 16 is positioned coaxially with the supporting tube 15 and extends around a lower end 17 of the supporting tube.

Preferably, the outer surface 12 of the loading form 11 is a cylindrical surface.

Preferably, the device 10 for preparing a knitted article comprises suction mechanisms (not shown, for example of a type known in the field) configured for sucking a remaining portion of knitted article freely hanging from the loading disc when the end portion of the knitted article is wrapped around the latter, inside an inner hollow 18 of the loading form. Preferably, the lower end 17 of the supporting tube, around which the loading disc develops, exhibits an opening from which the aforesaid inner hollow develops. Preferably, the inner hollow 18 develops axially inside the supporting tube 15.

Basically, the suction mechanisms allow to keep inside the inner hollow of the loading form the portion of knitted article that is not wrapped around the loading form and is not involved in the joining operations to the fabric strip. Typically, when the knitted article is a pair of tights, the suction mechanisms suck the legs 7 of the tights into the tube, as schematically shown e.g. in FIGS. 2 and 3. Thus, the portion of knitted article that is not stretched on the loading surface 12 can be kept inside the loading form, preventing it from hindering the joining operations or from interfering with parts of the apparatus during the mutual positioning of the loading form and of the loading members.

In a possible embodiment, not shown, the apparatus can comprise a pick-and-place device configured and arranged for picking a knitted article and wrapping it outside the loading form in an automatic manner.

Preferably, the loading members 31 comprise a plurality of loading elements 35 placed circumferentially around the second central axis A2 and moving radially in a selective manner at least between:

- a first configuration (shown by way of example in FIG. 4), wherein the loading elements are at a distance from the second central axis corresponding to a first radius, and wherein the fabric strip is positioned around the loading members, so that the first welt protrudes above from the loading members for a length corresponding to the difference between the axial size of the loading members and the height of the fabric strip;
- a second configuration (shown by way of example in FIG. 6), wherein the loading elements are at a distance from the second central axis corresponding to a second radius which is greater than the first radius, so as to stretch the fabric strip and let it adhere to the loading elements themselves, for a length corresponding to the axial size of the loading elements, and so that the length of fabric strip protruding above from the loading elements gets back to the second central axis and is stretched as far as the first welt.

Preferably, the loading elements 35 can further move in a selective manner in a third configuration (shown by way of example in FIG. 12), wherein the loading elements are at a distance from the second central axis corresponding to a third radius, between the first radius and the second radius, so as to let the first welt of the fabric strip match the open border of the knitted article.

Preferably, the switching of the loading elements between the aforesaid configurations, with the fabric strip wrapped around them, causes the widening and narrowing of the fabric strip due to its elasticity.

Preferably, the actuating means 70 of the loading members 31 comprise one or more actuators acting upon the loading elements 35 for selectively operating them between the first configuration, the second configuration and the third configuration.

Preferably, as shown by way of example in the figures, the loading elements 35 are vertical bars 36 placed circumferentially around the second central axis A2, preferably at the same angular distance, each vertical bar being oriented parallel to the second central axis.

Figure 4:
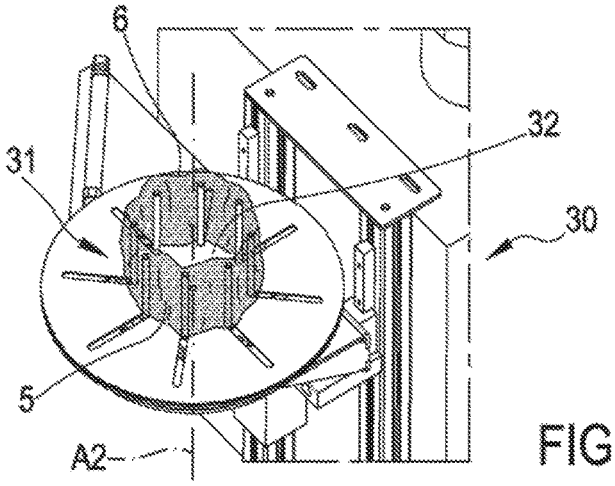
FIG. 4 shows a portion of the apparatus of FIG. 1, in particular the device for preparing a fabric strip, with a fabric strip loaded onto the loading members by way of example.

Preferably, the loading members define a wrapping surface on which the fabric strip is placed: this wrapping surface has a smaller axial size than said height of the fabric strip. This is schematically shown in FIGS. 4, 5A and 6. It can be observed that the wrapping surface can be defined as the envelope of the vertical bars constituting the loading members: basically, by wrapping outside the vertical bars with the fabric strip, the wrapping surface consists of the surfaces joining two adjacent vertical bars and can be substantially assimilated to a cylindrical surface.

Preferably, the vertical bars 36 can move radially, in a coordinated manner with respect to the second central axis A2, so that in the first configuration all the vertical bars lie at a distance from the second central axis corresponding to the first radius, in the second configuration all the vertical bars lie at a distance from the second central axis corresponding to the second radius, and in the third configuration all the vertical bars lie at a distance from the second central axis corresponding to said third radius.

Preferably, the positioning means 60 of the loading form 11 comprise a rotating tower 61 carrying the loading form and moving between a loading position, in which a knitted article is loaded onto the loading form, and a transfer position, in which the fabric strip wrapped around the loading members is moved onto the loading form, outside the end portion of the knitted article.

Figure 5:
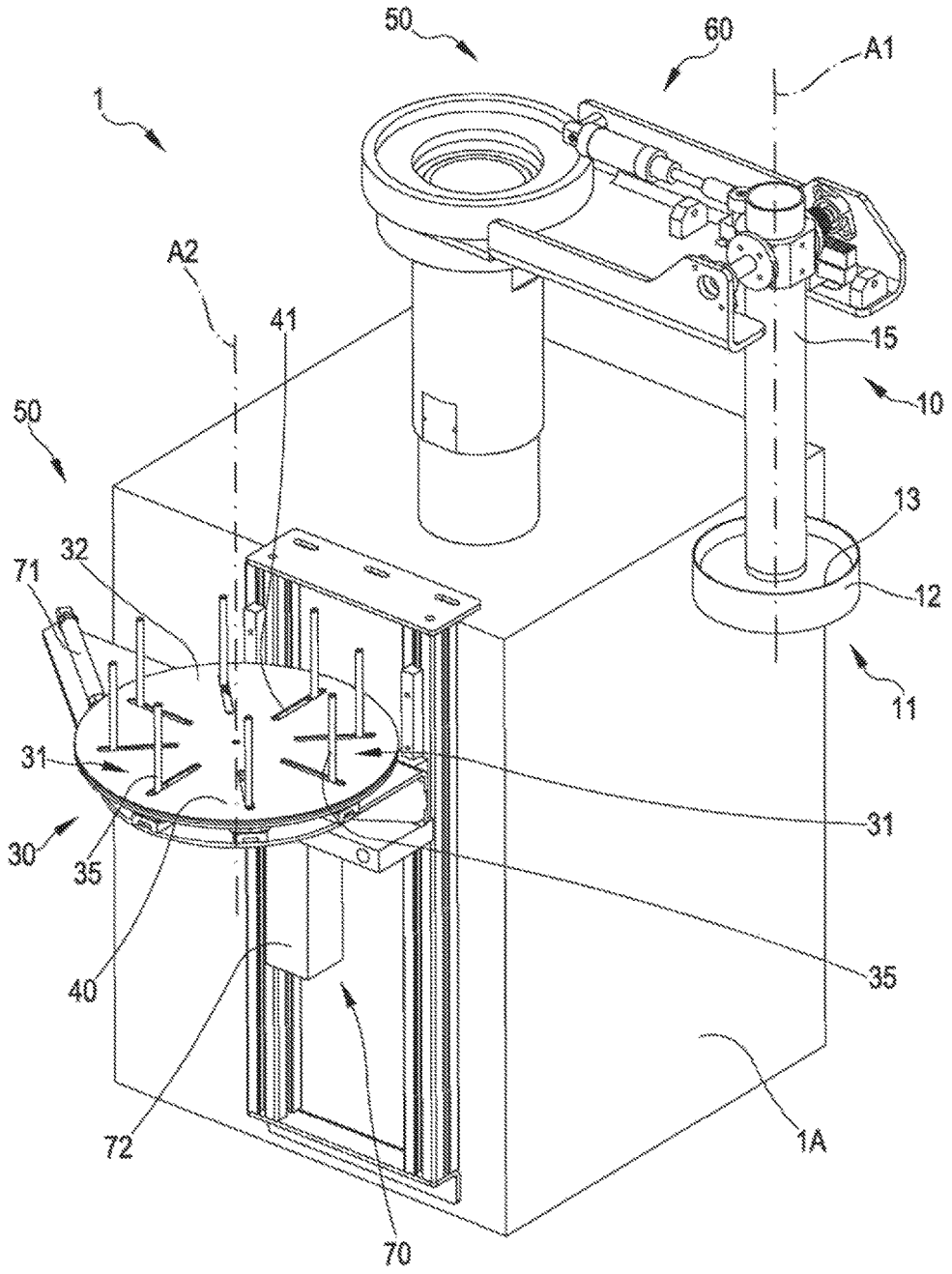
FIG. 5 shows the apparatus of FIG. 1, in a second operating condition.
Figure 5A:
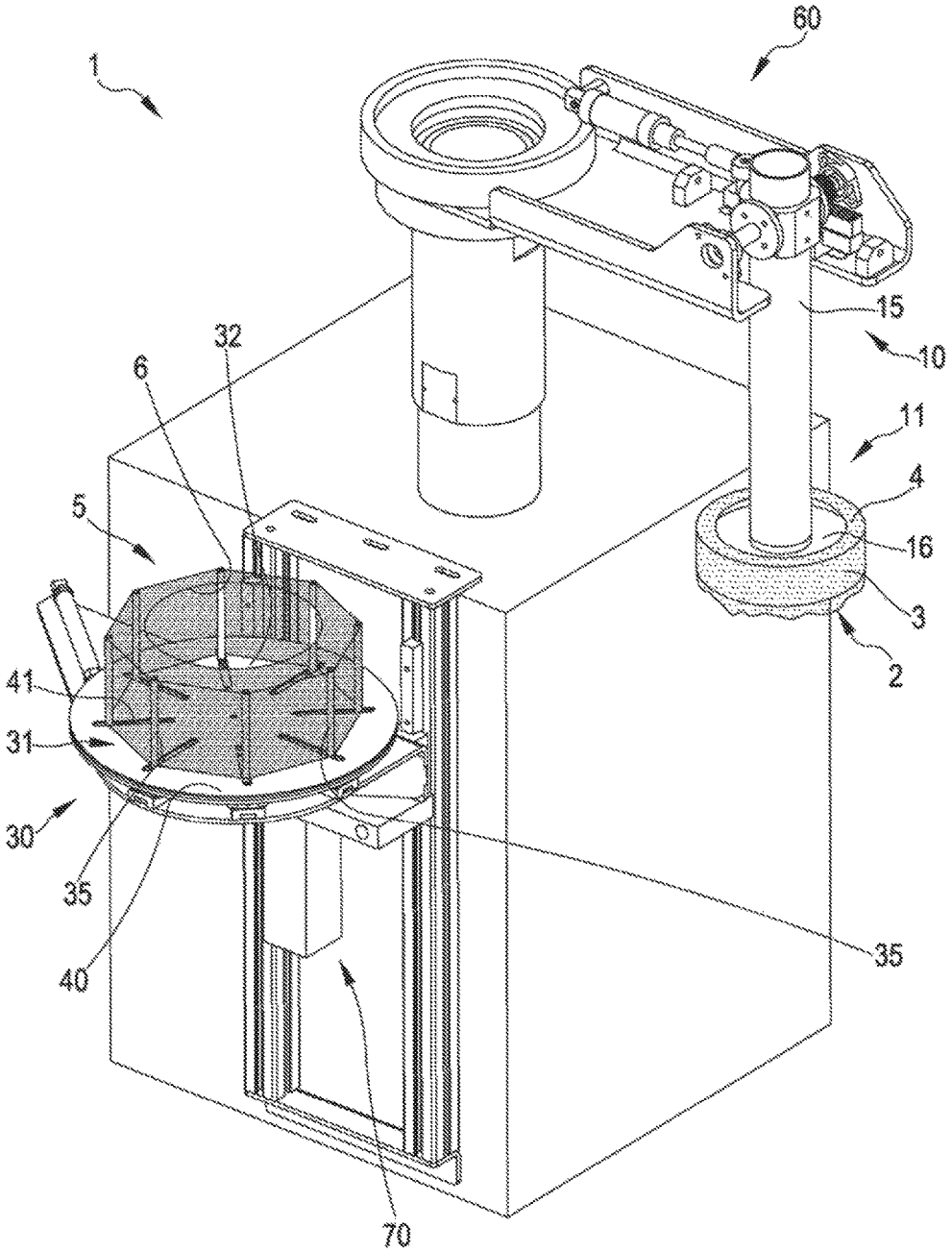
FIG. 5A shows the apparatus of FIG. 5, with a knitted article loaded onto the loading form by way of example and a fabric strip loaded onto the loading members by way of example.
Figure 6:
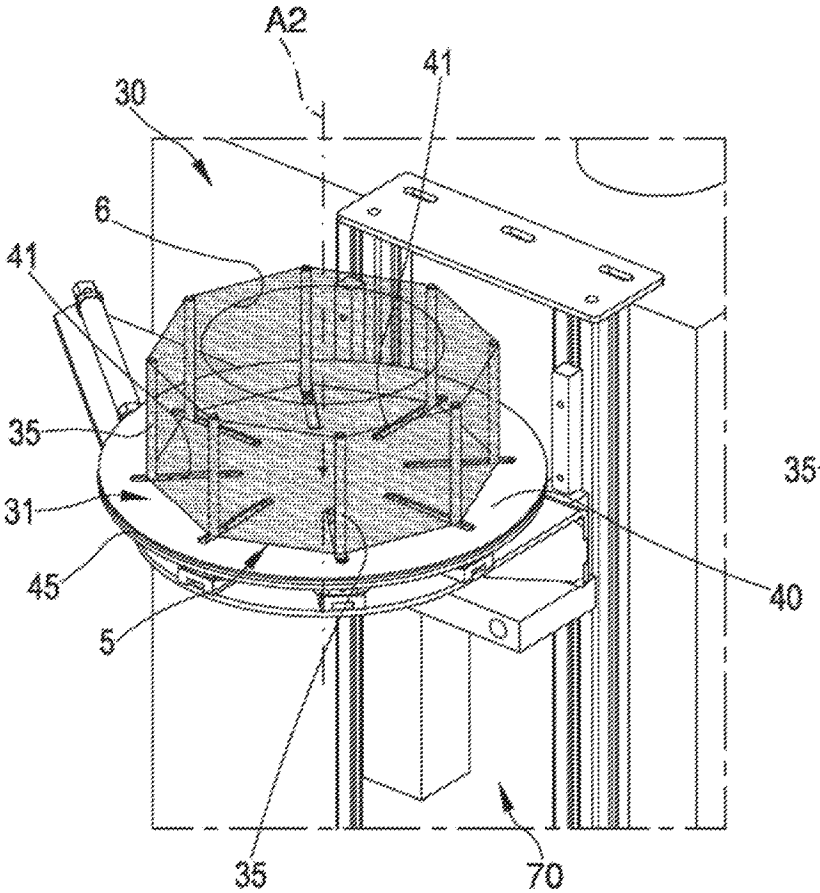
FIG. 6 shows a partial enlargement of FIG. 5 related to the loading members.
Figure 8:
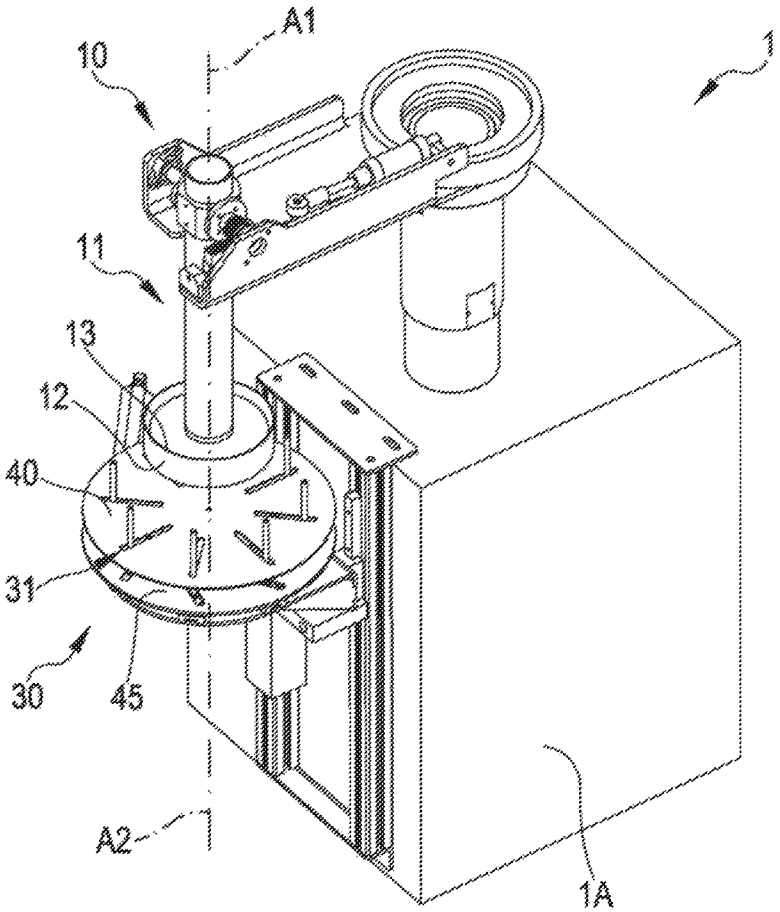
FIG. 8 shows the apparatus of FIG. 1, in a third operating condition.
Figure 10A:
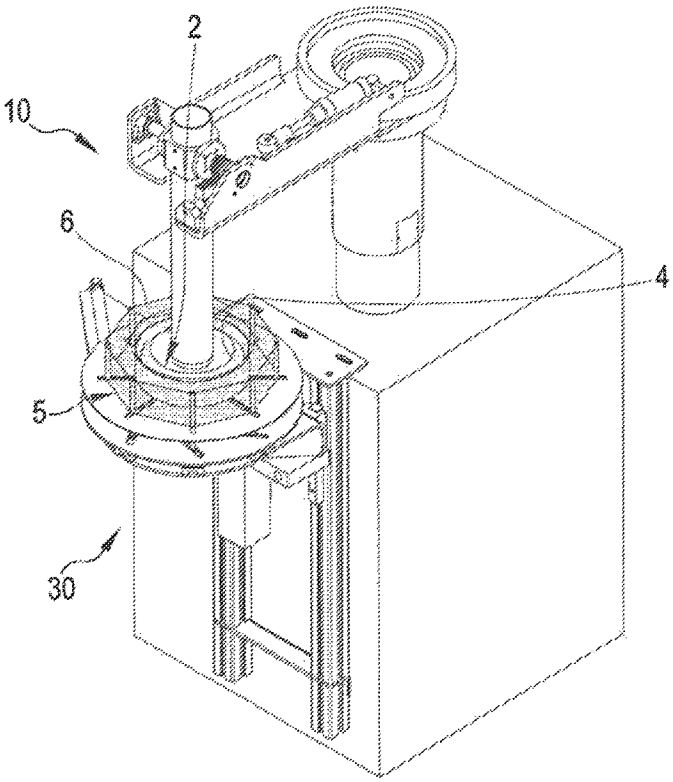
FIG. 10A shows the apparatus of FIG. 10, with a knitted article loaded onto the loading form by way of example and a fabric strip loaded onto the loading members by way of example.
Figure 10:
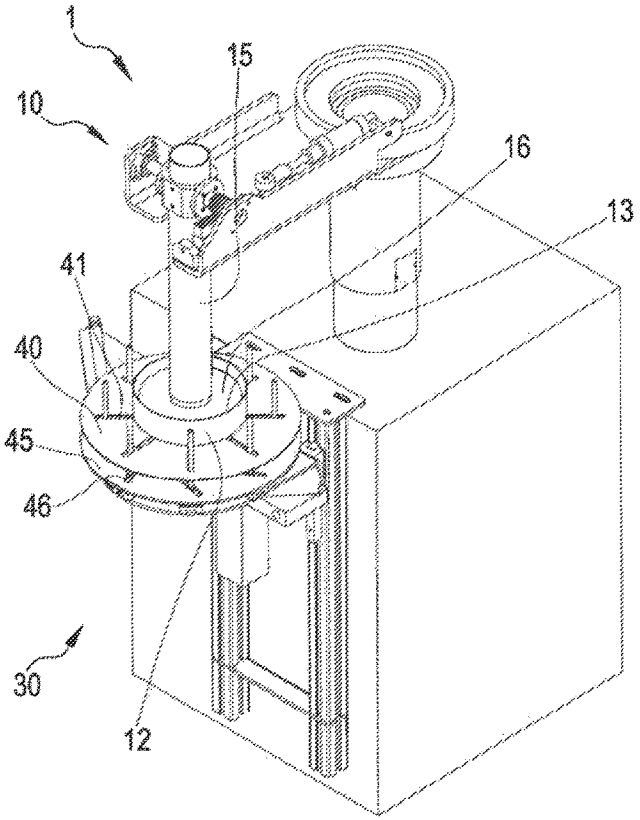
FIG. 10 shows the apparatus of FIG. 1, in a fourth operating condition.
Figure 11A:
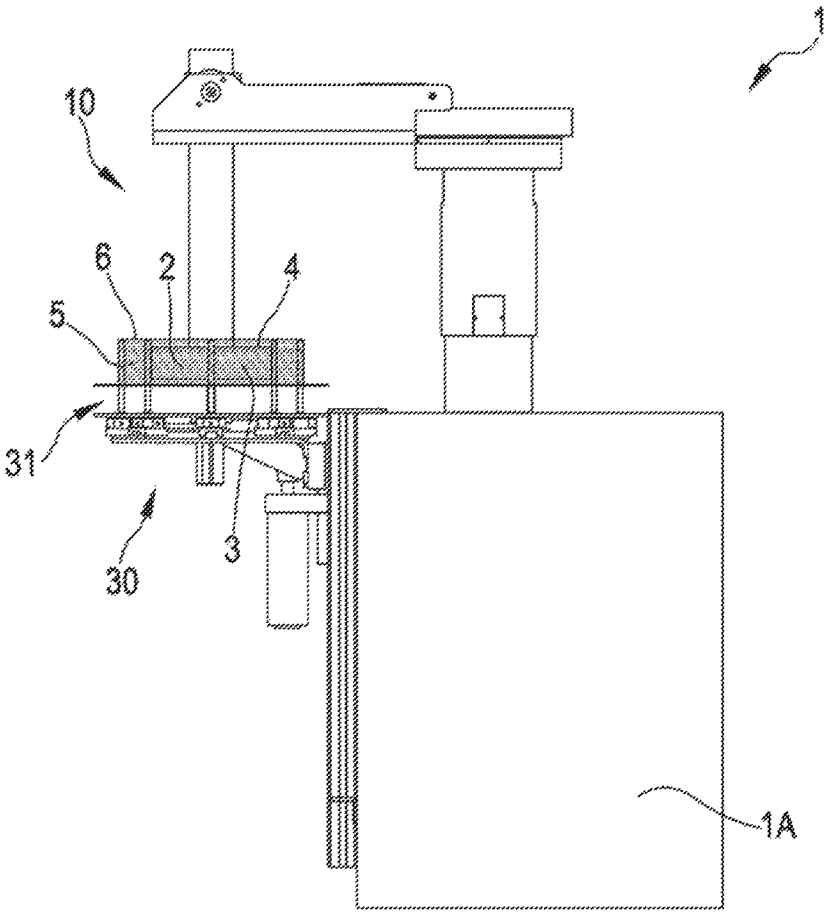
FIG. 11A shows the apparatus of FIG. 11, with a knitted article loaded onto the loading form by way of example and a fabric strip loaded onto the loading members by way of example.
Figure 11:
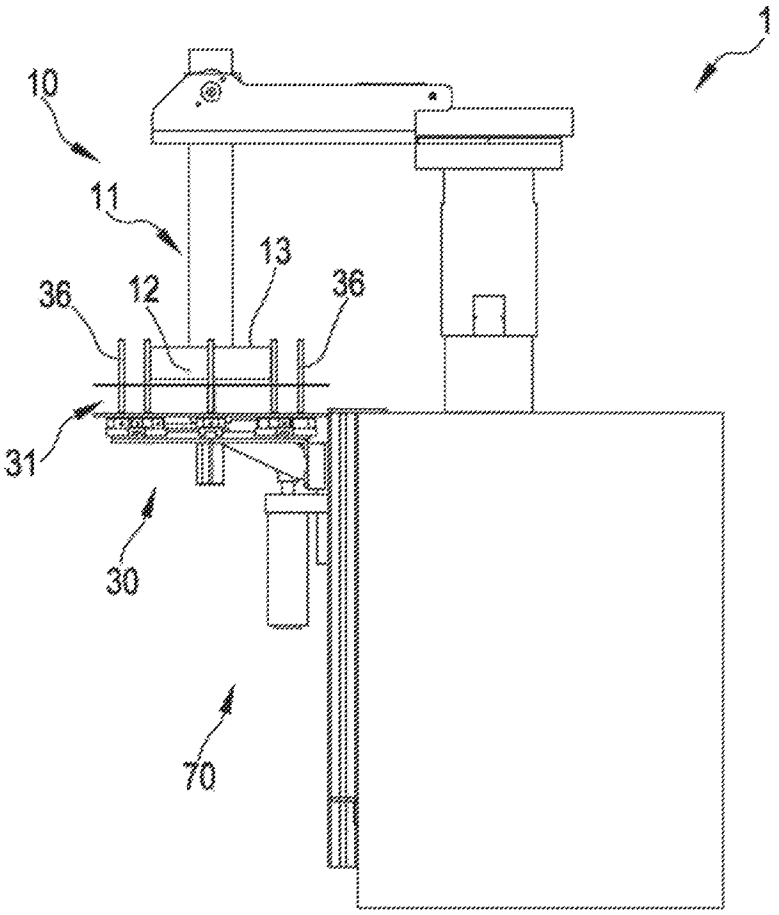
FIG. 11 shows a side view of the apparatus of FIG. 10.

The loading position is shown by way of example in FIGS. 1, 5 and 5A, whereas the transfer position is shown by way of example in FIGS. 8, 10 and 10A.

Preferably, the positioning means 60 of the loading form 11 comprise a first linear actuator 62 configured for axially moving the loading form 11 along the first central axis A1, so as to introduce the loading form 11 into the inner space 32 of the loading members 31. Preferably, the first linear actuator 62 comprises a rack-and-pinion transmission, as shown by way of example in FIG. 1, which controls the ascending and descending motion of the loading form along the first central axis A1.

Preferably, the rotating tower is moved by a drive comprising a motor and a transmission belt.

Preferably, the rotating tower is further configured for subjecting the loading form to the joining device.

Preferably, the actuating means 70 of the loading members 31 comprise a second linear actuator 72 configured for axially moving the loading members, simultaneously along the second central axis A2 so as to take the fabric strip out of the loading members and move it onto the loading form.

Preferably, the loading members 31 further comprise a base plate 40 from which the loading elements 35 (the vertical bars 36) protrude perpendicularly thereto. The base plate 40 can move axially along the second central axis A2 so as to define the value of the aforesaid axial size of the loading members (i.e. of the loading elements).

Basically, the axial position of the base plate 40 defines the height of the vertical bars 36 and as a result the length of the portion of fabric strip protruding from the upper end of the vertical bars and stretched towards the inner space 32 of the loading members (towards the second axis).

Preferably, the base plate 40 comprises a plurality of first through grooves 41 arranged radially with respect to the second central axis A2, wherein each groove slidably houses a respective vertical bar 36 and guides it in its movements between the first configuration, the second configuration and the third configuration.

Preferably, the base plate 40 is configured for being moved by the second linear actuator 72, together with the loading elements 35, so as to transfer the fabric strip 5 onto the end portion 3 of the knitted article 2.

Preferably, the actuating means 70 of the loading members 31 comprise a third actuator configured for axially moving the base plate 40, along the second central axis A2 and independently from the loading elements 35.

Preferably, the third actuator is configured for lowering the base plate with respect to the loading elements when introducing the loading form 11 into the inner space 32 of the loading members 31, so as to simplify the mutual positioning between the end portion of the knitted article, wrapped around the loading form, and the fabric strip, wrapped around the loading elements.

Preferably, the loading members comprise a supporting frame 45 (e.g. a supporting plate 45) placed below the base plate and configured for supporting and for guiding the loading elements.

Preferably, the supporting frame 45 comprises a plurality of second through grooves 46, each of them slidably housing a respective vertical bar 36; these second grooves are arranged tangentially to a circumference having a given radius with respect to the second central axis.

Preferably, each vertical bar 36 is housed above in the respective first groove 41 and below in the respective second groove 46.

Preferably, the supporting frame 45 comprises a respective actuator 71 configured for transmitting a rotation of the frame itself around the second central axis A2, so as to cause the vertical bars 36 to slide inside the second grooves 46 and as a result the vertical bars to radially slide inside the first grooves 41. Thus, to a rotation of the supporting frame in a first direction corresponds a radial shift of the vertical bars approaching the second central axis, and to a rotation of the supporting frame in a second direction, opposed to the first direction, corresponds a radial shift of the vertical bars getting away from the second central axis. Preferably, the selection of the direction of rotation of the supporting frame and the selection of the extent of this rotation allow to place the vertical bars at a distance from the second central axis corresponding to the first radius or to the second radius or to the third radius, corresponding to the first configuration or to the second configuration or to the third configuration, respectively, of the loading elements.

Figure 7:
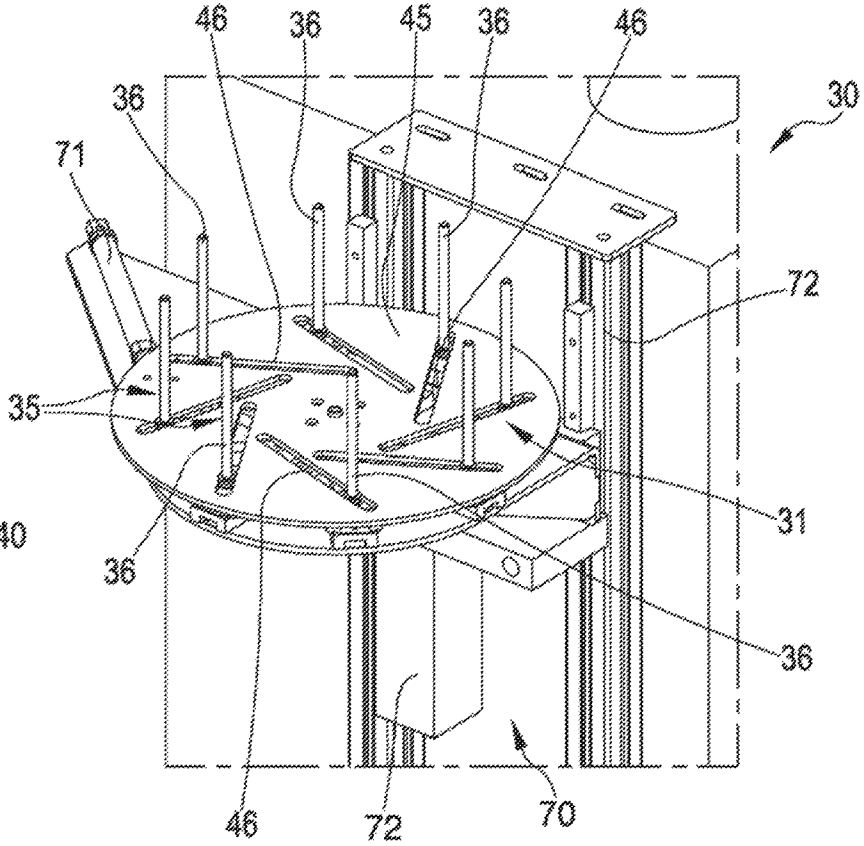
FIG. 7 shows a detail of FIG. 5 related to the loading members, some parts being removed.

The base plate 40, the supporting frame 45 and the respective grooves are shown in particular in FIGS. 6 and 7.

The apparatus comprises a frame 1A to which the device for preparing a knitted article, the device for preparing a fabric strip and the moving mechanisms are associated. The apparatus further comprises a control unit (not shown, preferably located inside the frame 1A) managing the operation of all the elements of the apparatus.

The apparatus described above is particularly suitable, though not exclusively, for implementing the method for assembling a fabric strip to a knitted article, wherein said knitted article is an object of the present invention.

Figure 2:
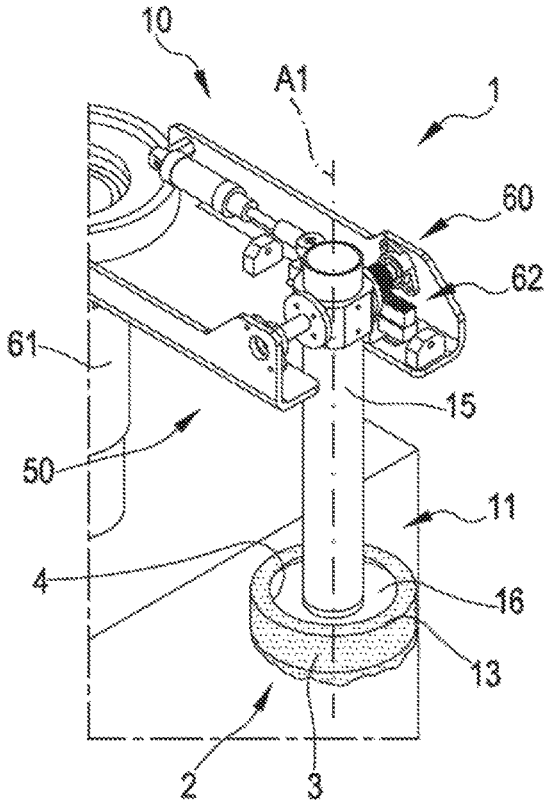
FIG. 2 shows a portion of the apparatus of FIG. 1, in particular the device for preparing a knitted article, with a knitted article loaded onto the loading form by way of example.
Figure 3:
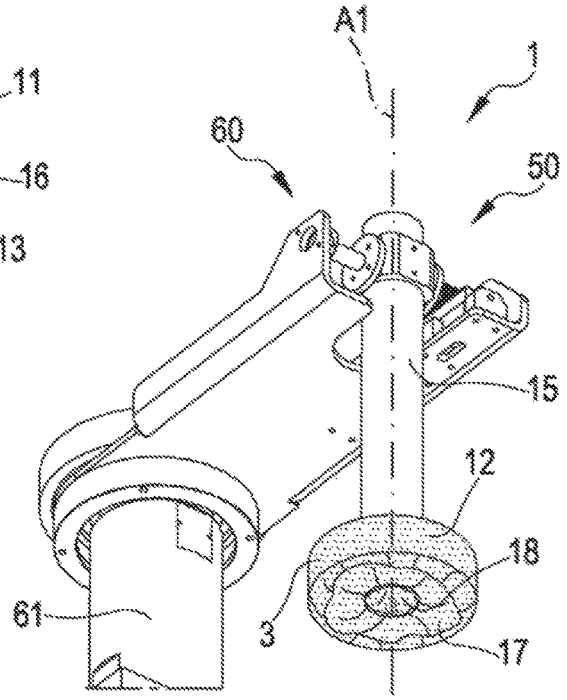
FIG. 3 shows the apparatus as in FIG. 2, according to a perspective view from below.

As disclosed above and clearly shown in the figures, the method comprises the following steps:

arranging a device 10 for preparing a knitted article, as described above;

at least partially loading a knitted article 2 onto the at least one loading form 11, wrapping at least the end portion 3 of the knitted article outside the loading form so that the end portion adheres to the outer surface 12 and at a certain distance from the first central axis A1, and so that the open border 4 lies beyond the first edge 13 and protrudes inwardly from the first edge towards the first central axis (see FIGS. 2, 3, 5A);

arranging a device 30 for preparing a fabric strip, as described above;

at least partially loading a fabric strip 5 onto the loading members 31, wrapping the fabric strip outside the loading members so that the fabric strip adheres to the loading members at a greater distance from the second central axis A2 than the respective distance of the end portion of the knitted article from the first central axis, and so that the first welt 6 protrudes inwardly from the loading members towards said second central axis A2 (see FIGS. 5A, 6).

Figure 9:
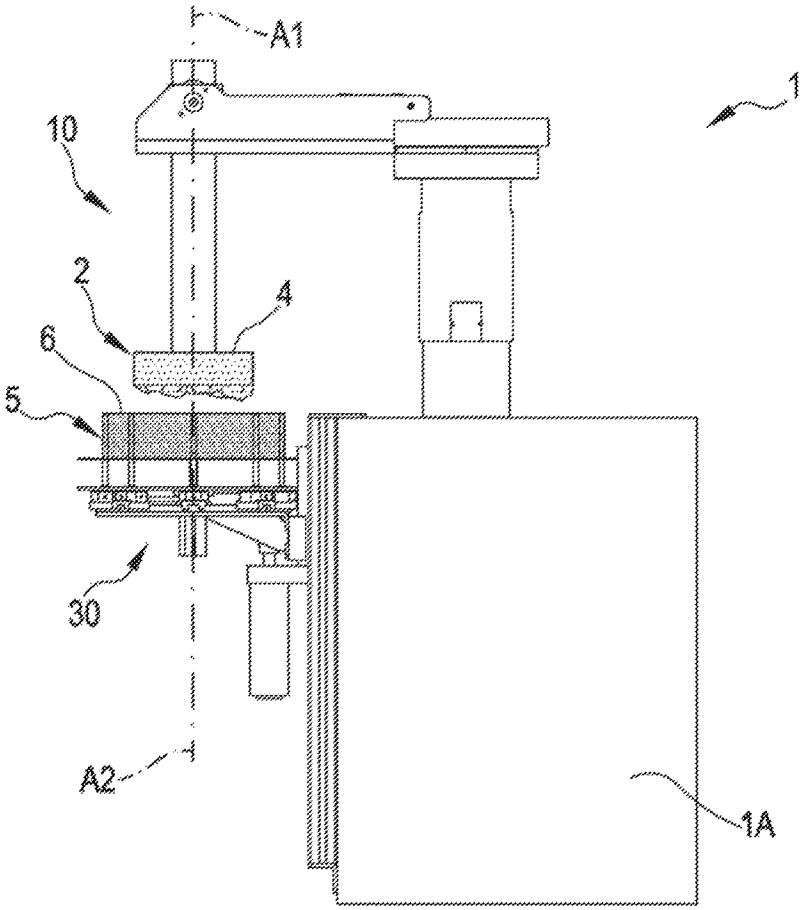
FIG. 9 shows a side view of the apparatus of FIG. 8, with a knitted article loaded onto the loading form by way of example and a fabric strip loaded onto the loading members by way of example.
Figure 12:
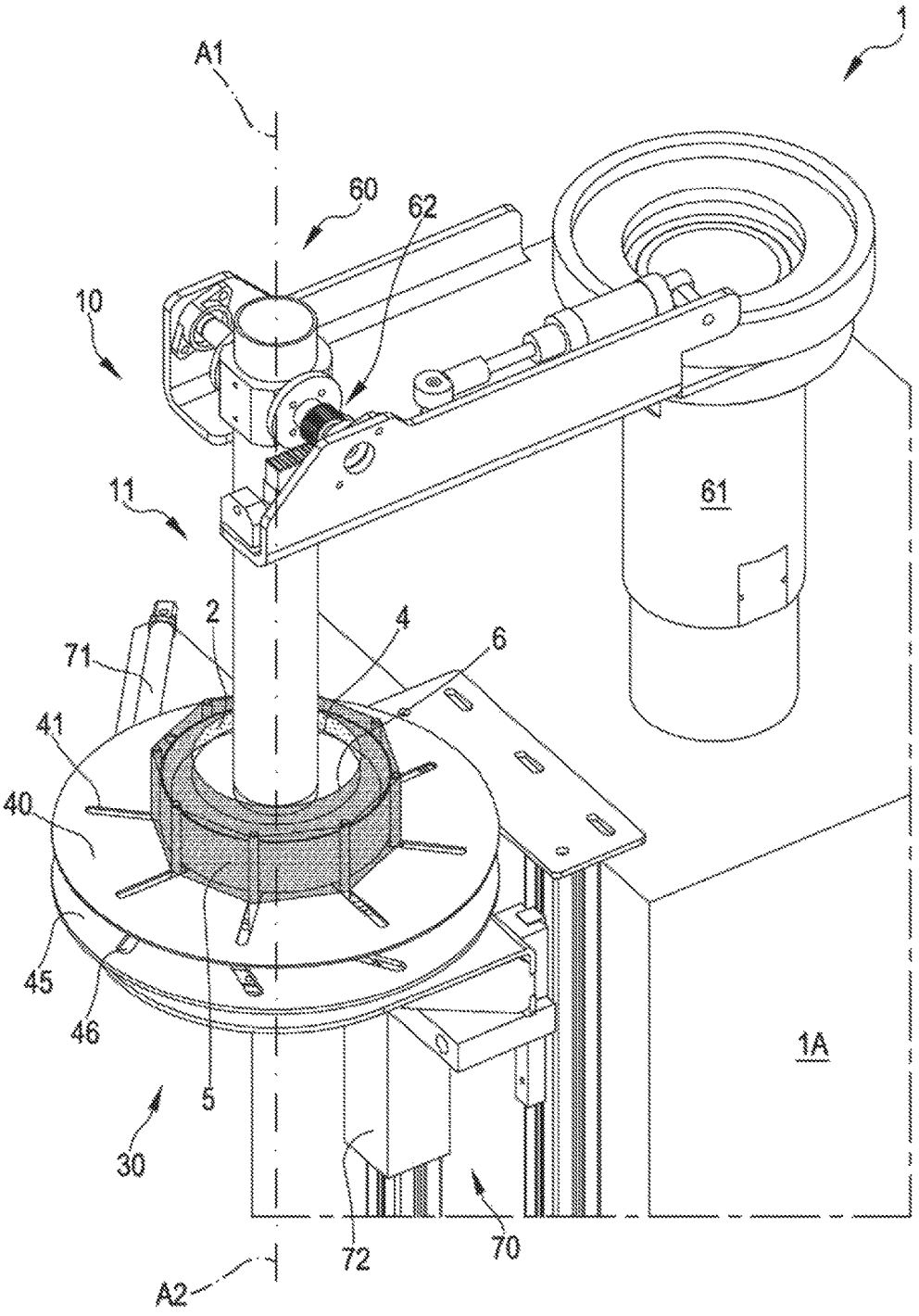
FIG. 12 shows the apparatus of FIG. 1, in a fifth operating condition.

The method thus comprises a step of mutually positioning said loading form 11 and the loading members 31; this step of mutually positioning comprises the following steps:

aligning the loading form 11 with respect to the loading members 31, so that the first central axis A1 is basically coincident with the second central axis A2 (see FIGS. 8 and 9);

introducing the loading form 11 into the inner space 32 of the loading members 31, placing the portion of knitted article wrapped outside the loading form in front of the fabric strip wrapped around the loading members, so that the fabric strip surrounds outside the end portion of the knitted article and lies concentrically with respect to the latter (see FIGS. 10, 10A, 11, 11A);

letting the first welt 6 of the fabric strip overlap and match the open border 4 of the knitted article and basically in contact with it (see FIG. 12);

taking the fabric strip 5 out of the loading members 31 so as to move it onto the loading form 11, keeping the mutual position taken by the first welt 6 of the fabric strip and by the open border 4 of the knitted article, the fabric strip being placed on the loading form outside (or above, so as to cover or coat it) the end portion of the knitted article.

The method thus comprises a step of joining the first welt of the fabric strip to the open border of the knitted article, so as to obtain one assembled knitted article.

The steps of loading the knitted article and the fabric strip enable to position the open border and the first welt on the loading form and on the loading members, respectively, so that they are free and accessible for the subsequent joining step. To this purpose, both the open border and the first welt protrude from the respective loading element of a given extent. Moreover, the aforesaid loading operations position in a precise manner the open border and the first welt, so that the subsequent operations of transferring the fabric strip onto the knitted article can take place automatically keeping a correct mutual positioning.

Preferably, the method comprises a final step of unloading the assembled textile item from the loading form.

The method can further comprise a step of iteratively repeating the aforesaid steps so as to manufacture sequentially a plurality of assembled textile items.

Preferably, the method of the present invention is configured for assembling a fabric strip 5 having a predefined elasticity to a knitted article 2 having a respective predefined elasticity. Fabric elasticity allows to perform the various steps and in particular to suitably stretch the knitted article on the loading form and the fabric strip on the loading members.

Preferably, the joining step comprises a step of sewing together, or heat-sealing or gluing or resin-coating or taping, the first welt 6 of the fabric strip and the open border 4 of the knitted article.

Preferably, the sewing step comprises a step of subjecting the edges on the form to a sewing machine of "overlook" "cut-and-sew" type.

In a possible embodiment, not shown, in the step of loading the knitted article onto the loading form, the end portion is wrapped around the loading disc 16, whereas the remaining portion of knitted article freely hangs from the loading form.

As an alternative, as shown in the figures, the step of loading the knitted article onto the loading form comprises a step of sucking the remaining portion of knitted article, freely hanging from the loading form, into the aforesaid inner hollow 18 of the loading form 11.

Preferably, the sucking step takes place before the step of wrapping the end portion of the knitted article outside the loading form. If e.g. a pair of tights has to be assembled, the operator introduces the legs 7 of the tights C into the hollow where suction is active, grasping the end portion 3; thus, the legs portion (not involved in the assembling process) does not hinder the subsequent steps and does not obstruct the work area. After sucking the legs, the operator positions the end portion 3 well stretched on the loading form, with the open border 4 beyond the first edge 13.

Preferably, the steps of loading the knitted article onto the loading form, of loading the fabric strip onto the loading members and of taking the fabric strip out of the loading members so as to transfer it onto the loading form, exploit the elasticity of the fabric strip and of the knitted article.

Preferably, as can be seen in the figures, in the step of loading the knitted article 2, the open border 4 protrudes inwardly from the first edge 13 towards the first central axis, in a direction basically perpendicular to the outer surface 12 of the loading form.

Preferably, the open border 4 of the knitted article 2 protrudes inwardly from the first edge 13 for a length corresponding to a first value. Preferably, the first welt 6 of the fabric strip 4 protrudes inwardly from the loading members 31 for a length corresponding to a second value. Preferably, the first value corresponds to the second value.

Preferably, once the step of loading the knitted article 2 has been completed, the distance of the open border to the first central axis is basically constant on the whole development of the open border; this is schematically shown in FIGS. 2 and 5A. Preferably, once the step of loading the fabric strip 5 has been completed, the distance of the first welt 6 to the second central axis A2 is basically constant on the whole development of the first welt; this is schematically shown in FIGS. 5A and 6.

Preferably, the portion of knitted article 2 protruding inwardly from the loading surface is shaped as a circular crown extending between the first edge 13 of the loading form and the open border 4 and developing around the first central axis.

Preferably, the portion of fabric strip 5 protruding inwardly from the loading members is shaped as a circular crown extending between the upper end of the loading members and the first welt 6 and developing around the second central axis.

Preferably, the step of at least partially loading a knitted article onto the loading form takes place manually or automatically, preferably by means of a pick-and-place device (not shown) configured and arranged for picking a knitted article and automatically wrapping it around the loading form.

Preferably, in the step of at least partially loading a knitted article onto the loading form, the end portion of the knitted article can comprise a line and/or a band and/or a graphic symbol and/or a texture and/or one or more stopping points defining a reference position of the knitted article, said reference position being destined to match (or correspond to) the first edge of the loading form so that the open border of the knitted article protrudes inwardly from the first edge for a length corresponding to the aforesaid first value. Basically, the reference position enables to correctly position the end portion 3 with respect to the first edge 13 of the loading form, so that the open border 4 protrudes inwardly from the form for a given length.

The knitted article 2 exhibits an inner side 8A destined—when using the knitted article—to get into contact with the user's body, and an outer side 9A, opposed to the inner side, destined to lie—when using the knitted article—outside the user's body.

The fabric strip 5 exhibits a respective inner side 8B destined—when using the knitted article—to get into contact with the user's body, and a respective outer side 9B, opposed to the inner side, destined to lie—when using the knitted article—outside the user's body.

Preferably, in the step of loading the knitted article 2, the article is wrapped around the loading form 11 so as to adhere to the loading form with the outer side 9A thereof and show outside the loading form the inner side 8A thereof. In this case, in the step of loading the knitted article, the article is wrapped around the loading form in an upside-down (or inside-out) configuration.

Preferably, in the step of loading the fabric strip 5, the strip is wrapped around the loading members so that the outer side 9B thereof is placed in front of the loading members and the inner side 8B thereof points outside the loading members. In this case, in the step of loading the fabric strip, the strip is wrapped around the loading members in an upside-down (or inside-out) configuration.

Thus, the strip is sewn or joined to the knitted articles on the respective inner sides, and therefore the outside of the resulting textile item is better from an aesthetic point of view.

Preferably, the fabric strip 5 extends on a given height in axial direction, i.e. along a direction parallel to a central axis of the strip, between the aforesaid first welt 6 and a second welt 6A destined—once the textile item has been assembled—to represent a free profile of the fabric strip and therefore of the textile item itself. As mentioned above, the loading members define a wrapping surface on which the fabric strip is placed: this wrapping surface has a smaller axial size than the aforesaid given height of the fabric strip.

Preferably, the step of loading the fabric strip comprises the following steps:

- positioning the fabric strip 5 around the loading members 31 so that the first welt 6 protrudes above from the loading members for a length corresponding to the difference between the axial size of the loading members and the height of the fabric strip; in this positioning step (shown in FIG. 4) the fabric strip is slack (i.e. loose);
- expanding, i.e. circumferentially placing at a mutual distance, the loading members 31 as far as the aforesaid greater distance from the second central axis A2 than the distance of the end portion 3 of the knitted article from the first central axis A1, and stretching the fabric strip so that it adheres to the loading members 31 (outside them) for a portion corresponding to the axial size of the loading members, and so that the length of fabric strip protruding above from the loading members gets back to the second central axis and is stretched as far as the first welt; this step is shown in FIGS. 5A and 6.

Preferably, in the step of loading the fabric strip, after the aforesaid step of expanding the loading members, the first welt 6 protrudes inwardly from the loading members towards the second central axis, in a direction basically perpendicular to the wrapping surface of the loading members.

Preferably, the aforesaid step of introducing the loading form 11 into the inner space 32 of the loading members 31 (see FIG. 10) is performed after the step of expanding the loading members.

Preferably, after the step of introducing the loading form 11 into an inner space 32 of the loading members, the step of letting the first welt of the fabric strip match the open border of the knitted article comprises a step of narrowing, i.e. concentrically approaching, the loading members 31 towards the second central axis A2, so as to approach the fabric strip and bring it basically into contact with the end portion of the knitted article, and so that the length of fabric strip getting back from the loading members towards the second central axis lies over the portion of knitted article protruding inwardly from the first edge of the loading form and ending with said open border. This step is shown in FIG. 12. Basically, the two loading steps (of the knitted article and of the fabric strip) allow to make the open border and the first welt, which represent the two edges to be joined, "get back" (to the first and to the second central axis, respectively) from the respective loading means (loading form and loading members). Thus, after the loading steps, the step of letting the first welt of the fabric strip overlap and match the open border of the knitted article enables to obtain a precise overlapping of the two edges to be joined, with a mutual positioning that allows to subject both of them together to the joining device (typically a "cut-and-sew" machine).

Preferably, the step of taking the fabric strip out of the loading members so as to move it onto the loading form comprises a step of moving the loading members away from the loading form, so that the loading members are taken out of the fabric strip letting the latter adhering outside the end portion of the knitted article.

Preferably, the step of at least partially loading a knitted article onto said at least one loading form is performed in a loading station for the knitted article, the step of at least partially loading a fabric strip onto said loading members is performed in a loading station for the fabric strip, the step of mutually positioning the loading form and the loading members is performed in a transfer station, and the step of joining the first welt of the fabric strip to the open border of the knitted article is performed in a joining station.

Preferably, the loading form can be moved in a selective manner between the loading station for the knitted article, the transfer station and the joining station. Preferably, the loading station for the fabric strip coincides with the transfer station. In practice: the fabric strip is loaded onto the loading members, the loading form (carrying the knitted article) is positioned on the loading member so as to transfer the strip onto the end portion of the knitted article, then the joining station is reached with the same loading form (now carrying both the article and the strip).

Preferably, at the end of the joining step the method comprises a step of bringing the loading form back to the loading station for the knitted article, so as to cyclically repeat the method steps on subsequent knitted articles and related fabric strips. The method can comprise a step of selecting or replacing the loading form and/or the loading members based on the shape and/or type of knitted article and fabric strip.

Globally, the figures show the different positions and configurations taken by the loading form, by the loading members, by the knitted article and by the fabric strip during an operating cycle.

In particular:

FIG. 1: loading form ready for loading the knitted article; loading members ready for loading the fabric strip (loading elements in first configuration, positioned at said first radius from the second central axis);

FIGS. 2 and 3: knitted article 2 loaded onto the loading form;

FIG. 4: fabric strip 5 positioned (slack) onto the loading members;

FIGS. 5, 5A, 6: loading form carrying the knitted article, with open border 4 protruding from the first edge 13; loading members carrying the fabric strip, with first welt 6 protruding into the inner space 32 (loading elements in second configuration, positioned at said second radius from the second central axis);

FIGS. 8 and 9: alignment of the loading form with respect to the loading members (first central axis corresponding to second central axis);

FIGS. 10, 10A, 11, 11A: introduction of the loading form into the inner space of the loading members;

FIG. 12: overlapping of the first welt 6 of the fabric strip 5 on the open border 4 of the knitted article 2 (loading elements in third configuration, positioned at said third radius from the second central axis).

Various aspects of the method, corresponding to the further aspects described above and/or implemented by means of components described above and belonging to the apparatus, are not repeated here. The further aspects of the manufacturing process, e.g. concerning sewing, that are not described in detail in the present description and not deriving from peculiar characteristics of the apparatus as described above, are to be considered as conventional.

The invention thus conceived can be subjected to various changes and variants, all of which fall within the scope of the inventive idea, and the components mentioned here can be replaced by other technically equivalent element. The invention achieves important advantages. First of all, the invention allows to overcome at least some of the drawbacks of known technique. The invention further allows to obtain textile items, in particular tights, with a high precision and/or basically without imperfections and/or to reduce manufacturing weight. The invention further allows to automatically assemble a fabric strip to a knitted article. The invention further allows to increase the assembling speed of a fabric strip to a knitted article, and in general to increase productivity. The invention further allows to improve quality and/or to obtain highly uniform productions across the various textile items, in particular tights. The invention further allows to simplify the manufacturing process for tights with respect to known methods. The invention further allows to reduce required manpower with respect to known methods. The invention further allows to assemble fabric strips to knitted articles in a simple, fast and automatic manner. The apparatus of the present invention is also easy and/or robust and/or cheap to make.

The invention claimed is:

1. A method for assembling a fabric strip to a knitted article, wherein said knitted article exhibits an end portion ending with a basically circular open border destined to be joined to said fabric strip, and wherein said fabric strip is basically ring-shaped and exhibits a first welt destined to be joined to said open border of the end portion of the knitted article, the method comprising the following steps:

arranging a device for preparing a knitted article, comprising at least a loading form provided with at least an outer loading surface developing around a first central axis and ending with a basically circular first edge;

at least partially loading a knitted article onto said at least one loading form, wrapping at least an end portion of the knitted article outside the loading form so that the end portion adheres to said outer surface and at a certain distance from the first central axis, and so that the open border lies beyond the first edge and protrudes inwardly from the first edge towards said first central axis;

arranging a device for preparing a fabric strip, comprising at least loading members configured for receiving outside a fabric strip destined to be assembled to the knitted article and for placing the fabric strip around a second central axis;

at least partially loading a fabric strip onto said loading members, wrapping the fabric strip outside the loading members so that the fabric strip adheres to the loading members at a greater distance from said second central axis than the respective distance of the end portion of the knitted article from the first central axis, and so that the first welt protrudes inwardly from the loading members towards said second central axis;

mutually positioning said loading form and said loading members, wherein said step of mutually positioning comprises the following steps:

aligning said loading form with respect to said loading members, so that said first central axis is basically coincident with said second central axis;

introducing the loading form into an inner space of the loading members, placing the portion of knitted article wrapped outside the loading form in front of the fabric strip wrapped around the loading members, so that the fabric strip surrounds outside the end portion of the knitted article and lies concentrically with respect to the latter;

letting the first welt of the fabric strip overlap and match the open border of the knitted article and basically in contact with it;

taking the fabric strip out of the loading members so as to move it onto the loading form, keeping the mutual position taken by the first welt of the fabric strip and by the open border of the knitted article, the fabric strip being placed on the loading form outside the outer portion of the knitted article;

joining the first welt of the fabric strip to the open border of the knitted article, so as to obtain an assembled, one-piece knitted article.

2. The method according to claim 1, wherein the steps of loading the knitted article onto the loading form, loading the fabric strip onto the loading members and/or the step of taking the fabric strip out of the loading members so as to move it onto the loading form, exploit the elasticity of the fabric strip and of the knitted article.

3. The method according to claim 1, wherein the portion of knitted article protruding inwardly from the loading surface is shaped as an annulus between the first edge of the loading form and the open border and developing around said first central axis, and wherein the portion of fabric strip protruding inwardly from the loading members is shaped as an annulus between the upper end of the loading members and the first welt and developing around said second central axis.

4. The method according to claim 1, wherein the fabric strip extends for a given height in axial direction, i.e. along a parallel direction to a central axis of the strip, between said first welt and a second welt, destined—once the knitted article is assembled—to form a free profile of the fabric strip and therefore of the knitted article itself, and wherein the loading members define a wrapping surface on which the fabric strip is placed, said wrapping surface having a smaller axial size than said height of the fabric strip, and wherein the step of loading the fabric strip comprises the following steps:

positioning the fabric strip around said loading members so that the first welt protrudes above from the loading members for a length corresponding to the difference between said axial size of the loading members and said height of the fabric strip, wherein in said positioning step the fabric strip is slack;

expanding the loading members as far as said greater distance from said second central axis than the distance of the end portion of the knitted article from the first central axis, and stretching the fabric strip so that it adheres to the loading members for a portion corresponding to the axial size of the loading members, and so that said length of fabric strip protruding above from the loading members gets back to said second central axis and is stretched as far as the first welt.

5. The method according to claim 1, wherein said step of introducing the loading form into an inner space of the loading members occurs after said step of expanding the loading members, and wherein, after said step of introducing the loading form into an inner space of the loading members, the step of letting the first welt of the fabric strip match the open border of the knitted article comprises a step of narrowing the loading members towards the second central axis, so as to approach the fabric strip and bring it basically into contact with the end portion of the knitted article, and so that said length of fabric strip getting back from the loading members towards the second central axis lies over the portion of knitted article protruding inwardly from the first edge of the loading form and ending with said open border.

6. The method according to claim 1, wherein, in said step of arranging a device for preparing a fabric strip, said loading members comprise a plurality of loading elements placed circumferentially around said second central axis and moving radially in a selective manner at least between:

a first configuration destined for executing said step of positioning the fabric strip around the loading members, wherein said loading elements are placed circumferentially around said second central axis at a distance from the latter corresponding to a first radius;

a second configuration in which said step of expanding the loading members and stretching the fabric strip occurs, wherein said loading elements are placed circumferentially around said second central axis at a distance from the latter corresponding to a second radius which is greater than said first radius, and wherein said step of introducing the loading form into an inner space of the loading members occurs with said loading elements in said second configuration.

7. An apparatus for assembling a fabric strip to a knitted article, wherein said knitted article exhibits an end portion ending with a basically circular open border destined to be joined to said fabric strip (5), and wherein said fabric strip is basically ring-shaped and has a first welt destined to be joined to said open border of the end portion of the knitted article, the apparatus comprising at least:

a device for preparing a knitted article, comprising at least a loading form provided with at least an outer loading surface developing around a first central axis and ending with a basically circular first edge, wherein said loading form is configured for being wrapped outside at least by an end portion of the knitted article, so that the end portion adheres to said outer surface and at a given distance from the first central axis, and so that the open border lies beyond said first edge and protrudes inwardly from the first edge towards said first central axis;

a device for preparing a fabric strip, comprising at least loading members configured for receiving outside a fabric strip destined to be assembled to the knitted article and for placing the fabric strip around a second central axis, wherein said loading members are configured for being wrapped outside by at least a portion of a fabric strip, so that the fabric strip adheres to the loading members at a greater distance from said second central axis than the respective distance of the end portion of the knitted article from the first central axis, and so that the first welt protrudes inwardly from the loading members towards said second central axis;

moving mechanisms configured and arranged for mutually positioning in an automatic manner said loading form and said loading members, so as to:

align said loading form with respect to said loading members, with said first central axis basically coincident with said second central axis;

introduce the loading form into an inner space of the loading members, placing the portion of knitted article wrapped outside the loading form in front of the fabric strip wrapped around the loading members, so that the fabric strip surrounds outside the end portion of the knitted article and lies concentrically with respect to the latter;

letting the first welt of the fabric strip overlap and match the open border of the knitted article and basically in contact with it.

8. The apparatus according to claim 7, wherein the moving mechanisms comprise positioning means for the loading form, configured for aligning the loading form with respect to the loading members, for introducing the loading form into an inner space of the loading members, and for letting the first welt overlap and match the open border of the knitted article, and wherein the moving mechanism comprise actuating means for the loading members configured for taking the fabric strip out of the loading members so as to move it onto the loading form, keeping the mutual position taken by the first welt of the fabric strip and by the open border of the knitted article.

9. The apparatus according to claim 7, wherein the loading form comprises a supporting tube supporting a loading disc, said loading disc having said outer loading surface and said first edge and being positioned coaxially with the supporting tube, or wherein the loading members comprise a plurality of loading elements placed circumferentially around said second central axis and moving radially in a selective manner at least between:

a first configuration, wherein said loading elements are at a distance from the second central axis corresponding to a first radius, and wherein the fabric strip is positioned around the loading members, so that the first welt protrudes above from the loading members for a length corresponding to the difference between the axial size of the loading members and the height of the fabric strip; and a second configuration, wherein said loading elements are at a distance from the second central axis corresponding to a second radius which is greater than said first radius, so as to stretch the fabric strip and let it adhere to the loading elements themselves, for a length corresponding to the axial size of the loading elements, and so that the length of fabric strip protruding above from the loading elements gets back to the second central axis and is stretched as far as the first welt; and/or a third configuration, wherein the loading elements are at a distance from the second central axis corresponding to a third radius, comprised between said first radius and said second radius, so as to let the first welt of the fabric strip match the open border of the knitted article, and wherein the actuating means of the loading members comprise one or more actuators acting upon the loading elements for selectively operating them between said first configuration, second configuration and/or third configuration.

10. The apparatus according to claim 9, wherein said loading elements are vertical bars placed circumferentially around the second central axis, preferably at the same angular distance, each vertical bar being oriented parallel to the second central axis, and wherein said vertical bars are configured to move radially, in a coordinated manner with respect to the second central axis, between said first configuration, second configuration and/or third configuration.

11. The method according to claim 1, wherein, in said step of loading the knitted article, the open border protrudes inwardly from the first edge towards said first central axis in a basically perpendicular direction to the outer surface of the loading form, and wherein the open border of the knitted article protrudes inwardly from the first edge for a length having a first value and the first welt of the fabric strip protrudes inwardly from the loading members for a length having a second value, and wherein said first value coincides with said second value.

12. The method according to claim 1, wherein, once said step of loading the knitted article has been completed, the distance of the open border from the first central axis is basically constant for the whole development of the open border and, once said step of loading the fabric strip has been completed, the distance of the first border from the second central axis is basically constant for the whole development of the first welt.

13. The method according to claim 1, wherein, in said step of loading the knitted article, said knitted article is wrapped around the loading form so as to adhere to the loading form with an outer side thereof and show outside the loading form an inner side thereof, and wherein, in said step of loading the fabric strip, said strip is wrapped around the loading members so that an outer side thereof is placed in front of the loading members and an inner side thereof points outside the loading members.

14. The method according to claim 1, wherein the step of taking the fabric strip out of the loading members so as to move it onto the loading form comprises a step of moving the loading members away from the loading form, so that the loading members are taken out of the fabric strip letting the latter adhering outside the end portion of the knitted article.

15. The method according to claim 6, wherein the loading elements in said second configuration position the strip at said greater distance from the second central axis than the distance of the end portion of the knitted article from the first central axis.

16. The method according to claim 6, wherein the loading elements are configured to be selectively moved to a third configuration destined for executing said step of narrowing the loading elements so as to let the first welt of the fabric strip match the open border of the knitted article, wherein said loading elements are placed circumferentially around said second central axis at a distance from the latter corresponding to a third radius, between said first radius and said second radius.

17. The apparatus according to claim 7, wherein the apparatus comprises a joining device configured and arranged for joining the first welt of the fabric strip to the open border of the knitted article, so as to obtain an assembled knitted article, and wherein said positioning means are configured for moving the loading form carrying the knitted article and the fabric strip and subjecting it to said joining device.

18. The apparatus according to claim 7, wherein said device for preparing a knitted article comprises suction mechanisms configured for sucking a remaining portion of knitted article freely hanging from the loading disc when the end portion of the knitted article is wrapped around the latter, inside an inner hollow of the loading form.

19. The apparatus according to claim 8, wherein the positioning means of the loading form comprise a rotating tower carrying said loading form and moving between a loading position, in which a knitted article is loaded onto the loading form, and a transfer position, in which the fabric strip wrapped around the loading members is moved onto the loading form, outside the end portion of the knitted article.

20. The apparatus according to claim 8, wherein the positioning means comprise a first linear actuator configured for axially moving the loading form along said first central axis, so as to introduce the loading form into said inner space of the loading members, and wherein the actuating means of the loading members comprise a second linear actuator configured for axially moving the loading members, simultaneously along said second central axis so as to take the fabric strip out of the loading members and move it onto the loading form.

* * * * *